US009464630B2

(12) United States Patent
Roman et al.

(10) Patent No.: US 9,464,630 B2
(45) Date of Patent: Oct. 11, 2016

(54) LOW ICE PNEUMATIC MOTOR EXHAUST MUFFLER

(75) Inventors: Timothy S. Roman, Minnetonka, MN (US); Adam K. Collins, Brooklyn Park, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 308 days.

(21) Appl. No.: 13/698,397

(22) PCT Filed: May 18, 2011

(86) PCT No.: PCT/US2011/000881

§ 371 (c)(1),
(2), (4) Date: Nov. 16, 2012

(87) PCT Pub. No.: WO2011/146118

PCT Pub. Date: Nov. 24, 2011

(65) Prior Publication Data

US 2013/0058802 A1 Mar. 7, 2013

Related U.S. Application Data

(60) Provisional application No. 61/345,655, filed on May 18, 2010.

(51) Int. Cl.
*F04B 39/00* (2006.01)
*F04B 45/04* (2006.01)
(Continued)

(52) U.S. Cl.
CPC ..... *F04B 39/0055* (2013.01); *F01N 1/24* (2013.01); *F04B 43/1136* (2013.01); *F04B 45/043* (2013.01); *F04B 45/053* (2013.01); *F04B 45/0536* (2013.01); *F15B 21/008* (2013.01)

(58) Field of Classification Search
CPC ..... F04D 39/0027; F04D 39/0038; F04D 39/005; F04D 39/0055; F04D 39/0061; F04D 43/06; F04D 45/033; F04D 45/04; F04D 45/043; F04D 45/053; F04B 43/026; F04B 45/0536; F04B 43/1136
USPC ..... 417/375, 392, 393; 181/230
See application file for complete search history.

(56) References Cited

U.S. PATENT DOCUMENTS 1,844,104 A * 2/1932 Schnell ..... F01N 1/10 181/256
2,205,899 A * 6/1940 Chipley ..... F01N 1/083 181/269

(Continued)

FOREIGN PATENT DOCUMENTS

CN 201078255 Y 6/2008
CN 201236736 Y 5/2009

(Continued)

OTHER PUBLICATIONS

Translation of first Office Action received in corresponding Chinese application No. 201180024449.6, issued Aug. 14, 2014.

(Continued)

*Primary Examiner* — Bryan Lettman
*Assistant Examiner* — Timothy P Solak
(74) *Attorney, Agent, or Firm* — Kinney & Lange, P.A.

(57) ABSTRACT

A muffler for a positive displacement pneumatic motor includes a case, an inlet, a diffuser, a pathway, and sound absorbing material. The inlet and the diffuser are attached to the case. The pathway extends between the inlet and the diffuser and allows ice to travel through the muffler. The sound absorbing material is positioned in the pathway and includes more than one duct through which gas passes.

20 Claims, 5 Drawing Sheets

(51) Int. Cl.

| | |
|---|---|
| ***F04B 45/053*** | (2006.01) |
| ***F04B 43/113*** | (2006.01) |
| ***F01N 1/24*** | (2006.01) |
| ***F15B 21/00*** | (2006.01) |

(56) References Cited

U.S. PATENT DOCUMENTS

| | | | | |
|---|---|---|---|---|
| 2,773,553 | A | 12/1956 | Heurich et al. | |
| 3,142,354 | A * | 7/1964 | Kammerer | F04B 39/005 164/109 |
| 3,842,932 | A * | 10/1974 | Gibel | F01N 1/10 181/258 |
| 4,109,749 | A * | 8/1978 | Sweet | 181/230 |
| 4,523,662 | A | 6/1985 | Tanaka et al. | |
| 5,559,310 | A | 9/1996 | Hoover et al. | |
| 5,567,118 | A * | 10/1996 | Grgurich | F04B 43/0736 417/393 |
| 5,869,793 | A * | 2/1999 | Berger et al. | 181/256 |
| 5,893,707 | A | 4/1999 | Simmons et al. | |
| 6,332,511 | B1 * | 12/2001 | Parlato et al. | 181/282 |
| 6,880,670 | B2 * | 4/2005 | Dondi | 181/269 |
| 6,983,820 | B2 * | 1/2006 | Boast et al. | 181/249 |
| 2003/0070870 | A1 * | 4/2003 | Reynolds | 181/230 |
| 2004/0065504 | A1 * | 4/2004 | Daniels | F04B 53/002 181/252 |
| 2004/0126247 | A1 * | 7/2004 | Broser et al. | 417/312 |
| 2004/0163887 | A1 * | 8/2004 | Ziehl | F01N 1/082 181/256 |
| 2005/0103566 | A1 * | 5/2005 | Sterling | 181/230 |
| 2008/0023265 | A1 * | 1/2008 | Frederiksen | F01N 1/04 181/257 |
| 2008/0083582 | A1 * | 4/2008 | Towne et al. | 181/230 |
| 2008/0314679 | A1 * | 12/2008 | Rowe et al. | 181/241 |
| 2009/0060759 | A1 * | 3/2009 | Sishtla | F04B 39/005 417/312 |
| 2009/0090530 | A1 * | 4/2009 | Roberts et al. | 173/219 |
| 2009/0107760 | A1 * | 4/2009 | Sammut | 181/241 |

FOREIGN PATENT DOCUMENTS

| | | | |
|---|---|---|---|
| CN | 101705956 | A | 5/2010 |
| EP | 0727580 | A1 | 8/1996 |
| GB | 2070682 | A | 9/1981 |
| JP | 2001271626 | A | 10/2001 |
| JP | 2009519394 | A | 5/2009 |
| KR | 2003-0008064 | A | 1/2003 |
| KR | 1020030008064 | A | 1/2003 |
| KR | 100939702 | B1 | 2/2010 |

OTHER PUBLICATIONS

The International Search Report and Written Opinion in counterpart International Application No. PCT/US2011/000881 filed May 18, 2011.

Examination Report dated Dec. 3, 2014, for corresponding Australian Patent Application No. 2011256835.

English translation of second Chinese Office Action dated May 5, 2015, for corresponding Chinese Application No. 201180024449.6.

Extended European Search Report for EP Application No. 11783862.3, dated Jun. 13, 2016, 7 pages.

* cited by examiner

LOW ICE PNEUMATIC MOTOR EXHAUST MUFFLER

BACKGROUND

Positive displacement pneumatic motors are used in a variety of applications because of their inherent ease of use, constant force output, safe operation in explosive environments, among other reasons. They function by supplying compressed gas to either a piston or diaphragm that then pushes against a load such as a pump. At the end of each stroke, the motor must exhaust the high pressure air and move in the opposite direction to repeat the cycle. This uncontrolled expansion of air at the end of the motor stroke can generate considerable and sometimes dangerous amounts of noise. The exhaust gas is also cooled by the expansion process. Any moisture present in the gas can condense and freeze, creating ice. If the ice is allowed to build up, it can inhibit or cease operation of the motor.

SUMMARY

According to one embodiment of the present invention, a muffler for a positive displacement pneumatic motor includes a case, an inlet, a diffuser, a pathway, and sound absorbing material. The inlet and the diffuser are attached to the case. The pathway extends between the inlet and the diffuser and allows ice to travel through the muffler. The sound absorbing material is positioned in the pathway and includes a duct through which gas passes.

In another embodiment, a positive displacement pneumatic motor includes a motor body, a fluid inlet, a pneumatic inlet, a piston, a pneumatic outlet, and a muffler. The fluid inlet supplies fluid to the motor and the pneumatic inlet supplies compressed gas to the motor. The piston is positioned in the motor body, moves due to force from the compressed gas, and exerts force on the fluid when the piston moves. The pneumatic outlet is attached to the motor body and expels gas from the motor after exerting force on the piston. The muffler includes a case, an inlet, a diffuser, a pathway, and sound absorbing material. The inlet and the diffuser are attached to the case. The pathway extends between the inlet and the diffuser and allows ice to travel through the muffler. The sound absorbing material is positioned in the pathway and includes a duct through which gas passes.

DETAILED DESCRIPTION

Figure 1:
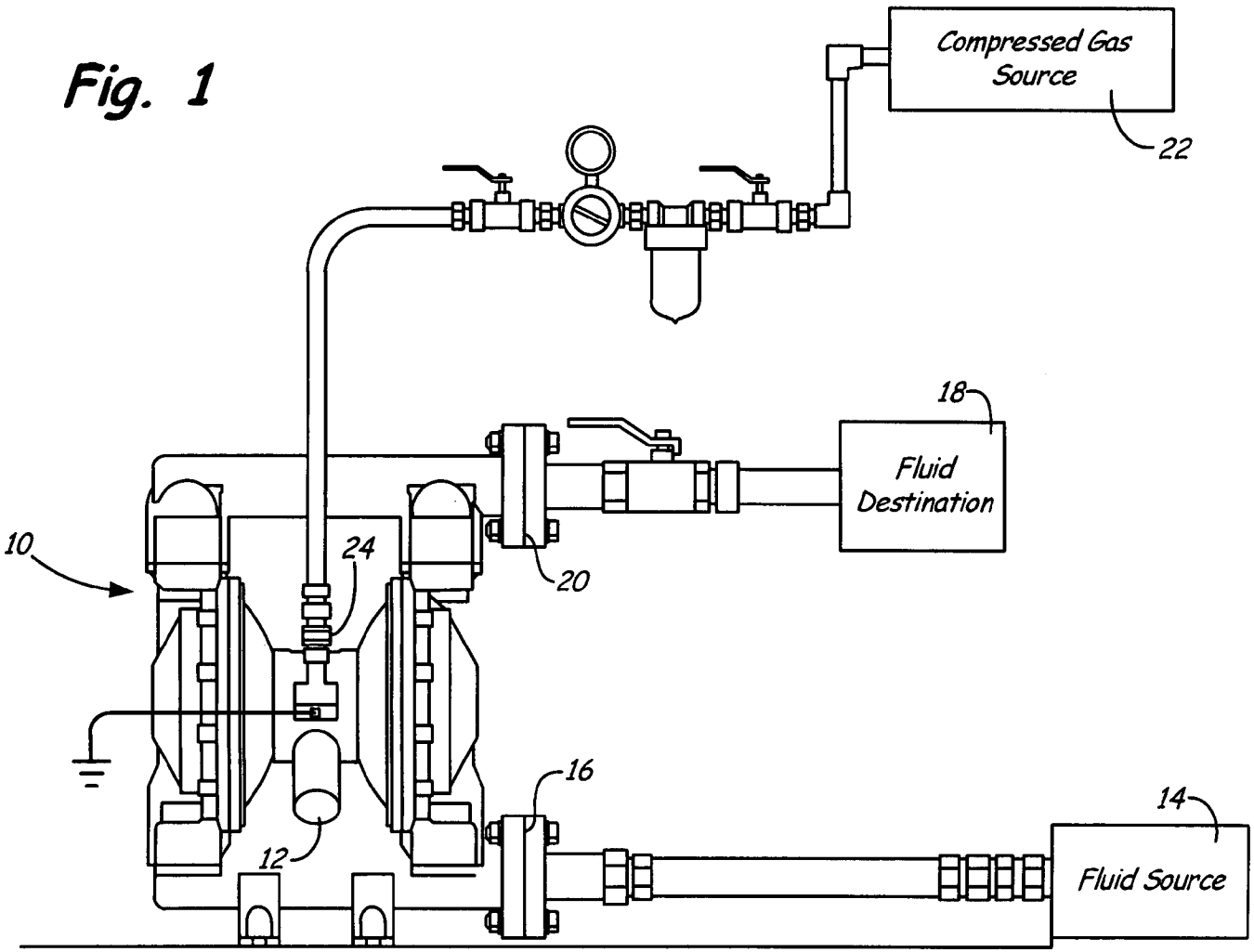
FIG. 1 is a front view of a positive displacement pneumatic motor.

In FIG. 1, a front view of positive displacement pneumatic motor 10 is shown. Shown in FIG. 1 are motor 10, muffler 12, -fluid source 14, fluid inlet 16, fluid destination 18, fluid outlet 20, compressed gas source 22, and pneumatic inlet 24.

Motor 10 is connected to fluid source 14 at fluid inlet 16 and to fluid destination 18 at fluid outlet 20. Motor 10 is also connected to compressed gas source 22 at pneumatic inlet 24. Attached to the exterior of motor 10 is muffler 12.

In the illustrated embodiment, motor 10 is a double diaphragm pump. Thereby, motor 10 uses compressed gas from compressed gas source 22 to pump fluid from fluid source 14 to fluid destination 18. As part of the working cycle of motor 10, used compressed gas is exhausted to the atmosphere through muffler 12.

Depicted in FIG. 1 is one embodiment of the present invention, to which there are alternative embodiments. For example, motor 10 can be a different type of pneumatic device, such as, a pneumatic cylinder. In such an embodiment, motor 10 is not a pump, so fluid source 14, fluid inlet 16, fluid destination, and fluid outlet 20 are not required.

Figure 2:
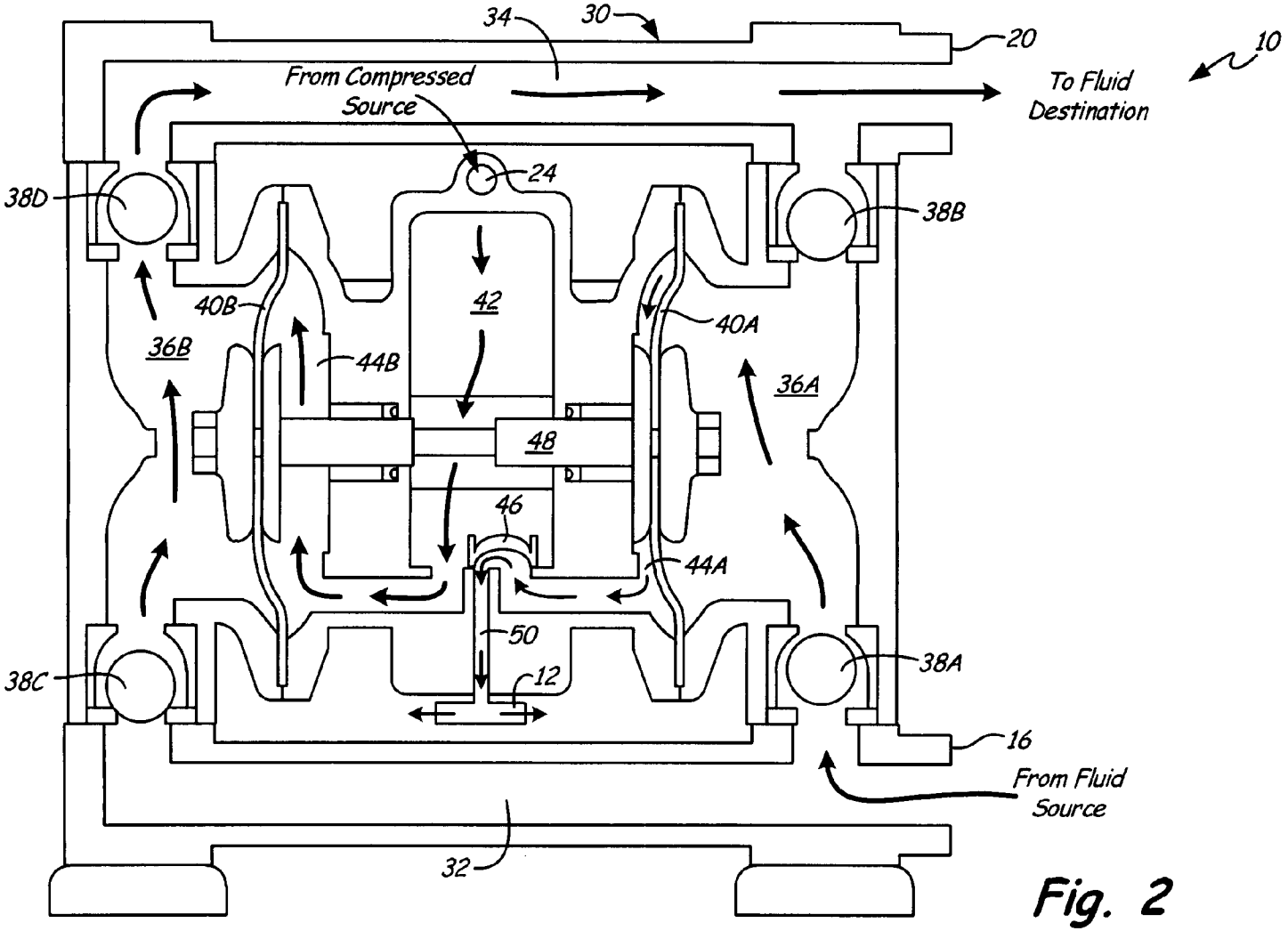
FIG. 2 is a front cross-section view of the positive displacement pneumatic motor showing fluid flow.

In FIG. 2, a front cross-section view of positive displacement pneumatic motor 10, including internal fluid flow, is shown. Shown in FIG. 2 are motor 10, muffler 12, fluid inlet 16, fluid outlet 20, pneumatic inlet 24, motor body 30, inlet manifold 32, outlet manifold 34, fluid chambers 36A-36B, check valves 38A-38D, diaphragms 40A-40B, gas manifold 42, gas chambers 44A-44B, gas valve 46, piston 48, and pneumatic outlet 50.

Motor 10 has motor body 30 which includes fluid inlet 16, fluid outlet 20, and pneumatic inlet 24. Fluidly connected to fluid inlet 16 is inlet manifold 32 and fluidly connected to fluid outlet 20 is outlet manifold 34. Extending between inlet manifold 32 and outlet manifold 34 are fluid chambers 36A-36B. Fluid chamber 36A is bounded by motor body 30, check valves 38A-38B, and diaphragm 40A. Fluid chamber 36B is bounded by motor body 30, check valves 38C-38D, and diaphragm 40B.

Fluidly connected to pneumatic inlet 24 is gas manifold 42, with gas manifold 42 being fluidly connected to gas chambers 44A-44B. Gas chambers 44A-44B are bounded by motor body 30 and diaphragms 40A-40B, respectively. Slidably positioned in gas manifold 42, motor body 30, and gas chambers 44A-44B is piston 48. Piston 48 is connected to diaphragm 40A at one end and to diaphragm 40B at the opposite end.

Slidably positioned in gas manifold 42 near gas chambers 44A-44B is gas valve 46. Gas valve 46 covers pneumatic outlet 50. Fluidly connected to pneumatic outlet 50 and attached to motor body 30 is muffler 12.

In order to pump fluid from fluid source 14 to fluid destination 18 (both shown in FIG. 1), valve actuator (not shown) moves gas valve 46 side-to-side. As shown in FIG. 2, gas valve 46 is positioned between gas manifold 42 and gas chamber 44A. This causes compressed gas from gas manifold 42 to flow into gas chamber 44B. The compressed gas exerts force on diaphragm 40B, expanding gas chamber 44B and causing diaphragm 40B and piston 48 to move toward fluid chamber 36B. This movement reduces the volume of fluid chamber 36B, forcing fluid contained therein through check valve 38D into outlet manifold 34 (because check valve 38C prevents backflow into inlet manifold 32).

The movement of piston 48 reduces the volume of gas chamber 44A. Because gas valve 46 has fluidly connected gas chamber 44A with pneumatic outlet 50, the compressed gas in gas chamber 44A flows through pneumatic outlet 50, into muffler 12, and out to the atmosphere. The movement of piston 48 also expands fluid chamber 36A, which causes fluid to be drawn up through check valve 38A from inlet manifold 32 (because check valve 38B prevents backflow from outlet manifold 34).

After this first half of the pumping cycle is complete, gas valve 46 will be moved by the valve actuator (not shown) to fluidly connect gas chamber 44B with pneumatic outlet 50. Then the cycle continues with the roles of fluid chambers 36A-36B and gas chambers 44A-44B being reversed, respectively. More specifically, fluid chamber 36A will force fluid into outlet manifold 34 while fluid chamber 36B will draw in fluid from inlet manifold 32. In addition, gas chamber 44A will receive compressed gas from gas manifold 42 while gas chamber 44B will exhaust gas to the atmosphere through muffler 12.

The components and configuration of motor 10 as shown in FIG. 2 allow for compressed gas from compressed gas source 22 (shown in FIG. 1) to be used to pump fluid from fluid source 14 to fluid destination 18 (both shown in FIG. 1). In addition, after the compressed gas is used, it is exhausted to the atmosphere through muffler 12.

Figure 3B:
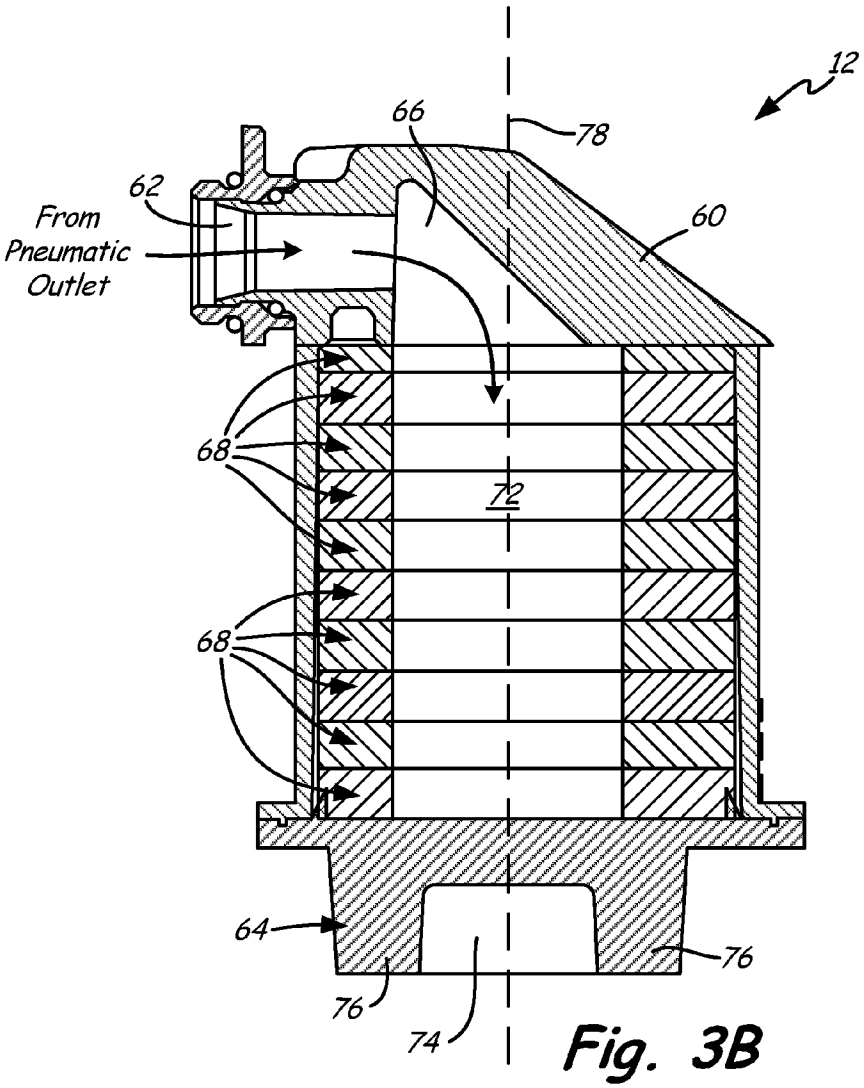
FIG. 3B is a side cross-section view of the muffler showing an inlet along section line 3B-3B in FIG. 3A.
Figure 3A:
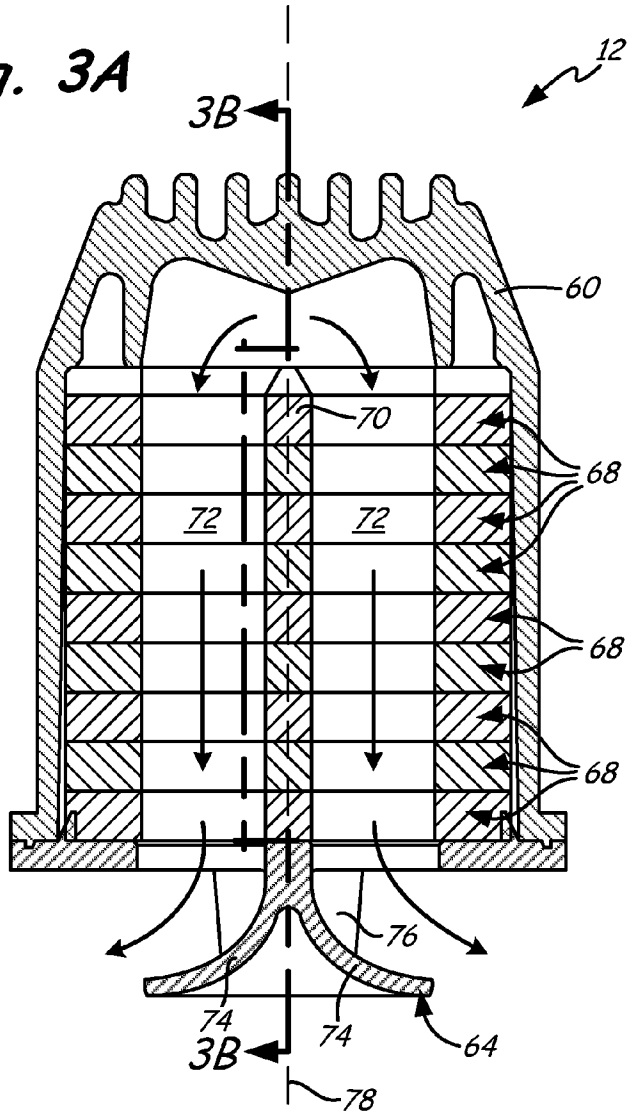
FIG. 3A is a front cross-section view of a muffler showing sound absorbing material and a diffuser.

In FIG. 3A, a front cross-section view of muffler 12 is shown, including sound absorbing material 68 and diffuser 64. In FIG. 3B, a side cross-section view of muffler 12 is shown, including inlet 62. Shown in FIGS. 3A-3B are muffler 12, muffler case 60, muffler inlet 62, diffuser 64, pathway 66, sound absorbing material 68, septum 70, ducts 72, diffuser ramps 74, diffuser supports 76, and muffler axis 78. The discussion of FIGS. 3A-3B will occur simultaneously.

Muffler 12 includes muffler case 60, to which muffler inlet 62 is attached. Diffuser 64 is also attached to muffler case 60. Extending through the interior of muffler case 60, between muffler inlet 62 and diffuser 64, is pathway 66. Positioned in pathway 66 is sound absorbing material 68. In the illustrated embodiment, sound absorbing material 68 is comprised of a number of die-cut layers of felt material that are stacked axially inside of muffler case 60 (along muffler axis 78). Sound absorbing material 68 has two ducts 72, which are separated by septum 70. Ducts 72 are substantially parallel to muffler axis 78 and are substantially orthogonal to muffler inlet 62.

In the illustrated embodiment, diffuser 64 is comprised of two diffuser ramps 74 and two diffuser supports 76. Diffuser ramps 74 begin near septum 70 and extend away from muffler case 60. Diffuser ramps 74 also curve radially outward away from muffler axis 78 and extend substantially to the projections of the outer edges of ducts 72, respectively. Diffuser supports 76 are positioned alongside diffuser ramps 74 and each diffuser support 74 is attached to both muffler case 60 and diffuser ramps 74. Diffuser supports 74 provide structural support to diffuser ramps 74.

When compressed gas enters muffler inlet 62, it is decompressing. The gas continues to decompress as it travels through pathway 66 and is diverted ninety degrees by a bend in pathway 66. This ninety degree turn causes turbulence in the exiting gas, slowing the gas. After the bend, the gas travels into one of ducts 72. Sound absorbing material 68 absorbs noise that is created from the flowing, expanding gas. Sound absorbing material 68 increases air resistance inside pathway 66, and the sonic energy is transformed into heat energy as the gas passes by sound absorbing material 68. As the gas exits one of ducts 72, it encounters the respective diffuser ramp 74 and is directed radially outward. As the gas is exhausted from muffler 12, it decompresses until it reaches atmospheric pressure. The gas is also allowed to expand radially outward in substantially all directions. The only restriction on being a complete three-hundred-sixty degree expansion is diffuser supports 76. This broad distribution of the exhausting gas is less damaging, dangerous, and annoying to the surrounding environment and bystanders.

The components and configuration of muffler 12 as shown in FIGS. 3A-3B allow for the reduction of noise caused by the compressed gas being exhausted. This occurs due to the ninety degree turn in pathway 66 after muffler inlet 62, sound absorbing material 68 and ducts 72, and diffuser ramps 74. The ninety degree turn in pathway 66 slows the gas, which causes the gas to spend more time in muffler 12 prior to exiting. This exposes the gas to sound absorbing material 68 for a longer period of time, allowing sound absorbing material 68 to convert more sonic energy to heat energy. With respect to ducts 72, having a plurality of ducts 72 increases the surface area of sound absorbing material 68 that the exiting gas is exposed to. With respect to diffuser ramps 74, not only do they disperse the exiting gas but they also block a direct line-of-sight flow path from muffler inlet 62 to the atmosphere.

Additionally, any ice that is formed in motor 10 can be expelled therefrom. This is because muffler inlet 62, pathway 66, ducts 72, and diffuser 64 are sufficiently large, and sound absorbing material 68 does not obstruct the flow of gas through muffler 12. Moreover, exiting gas flows alongside of sound absorbing material 68 and is not forced to travel through the bulk of sound absorbing material 68. Therefore, ice can be propelled by exiting gas through muffler 12 without getting captured or trapped inside muffler 12.

Also, the gas is exhausted from muffler 12 over a broad area, as opposed to a narrow jet that can be harmful by propelling ice fragments, dispersing resting dust into the atmosphere, removing paint from surfaces, distracting users, among other things. Furthermore, the ninety degree bend in pathway 66 prevents muffler 12 from projecting straight away from motor 10 (shown in FIG. 1). Instead, muffler 12 has a low profile that lies alongside of motor body 30 (shown in FIG. 2).

Depicted in FIGS. 3A-3B is one embodiment of the present invention, to which there are alternative embodiments. For example, muffler 12 can have more than two ducts 72. In such an embodiment, there is also more than one septum 70. For another example, muffler 12 can have one duct 72, and such an embodiment does not require septum 70. For a further example, diffuser ramps 74 can extend past the projections of the outer edges of ducts 72, respectively.

Depicted in FIGS. 3A-3B are one embodiment of the present invention, to which there are alternative embodiments. For example, sound absorbing material 68 can be comprised of a variety of sound absorbing materials, such as sintered metal or open cell foam.

Figure 4:
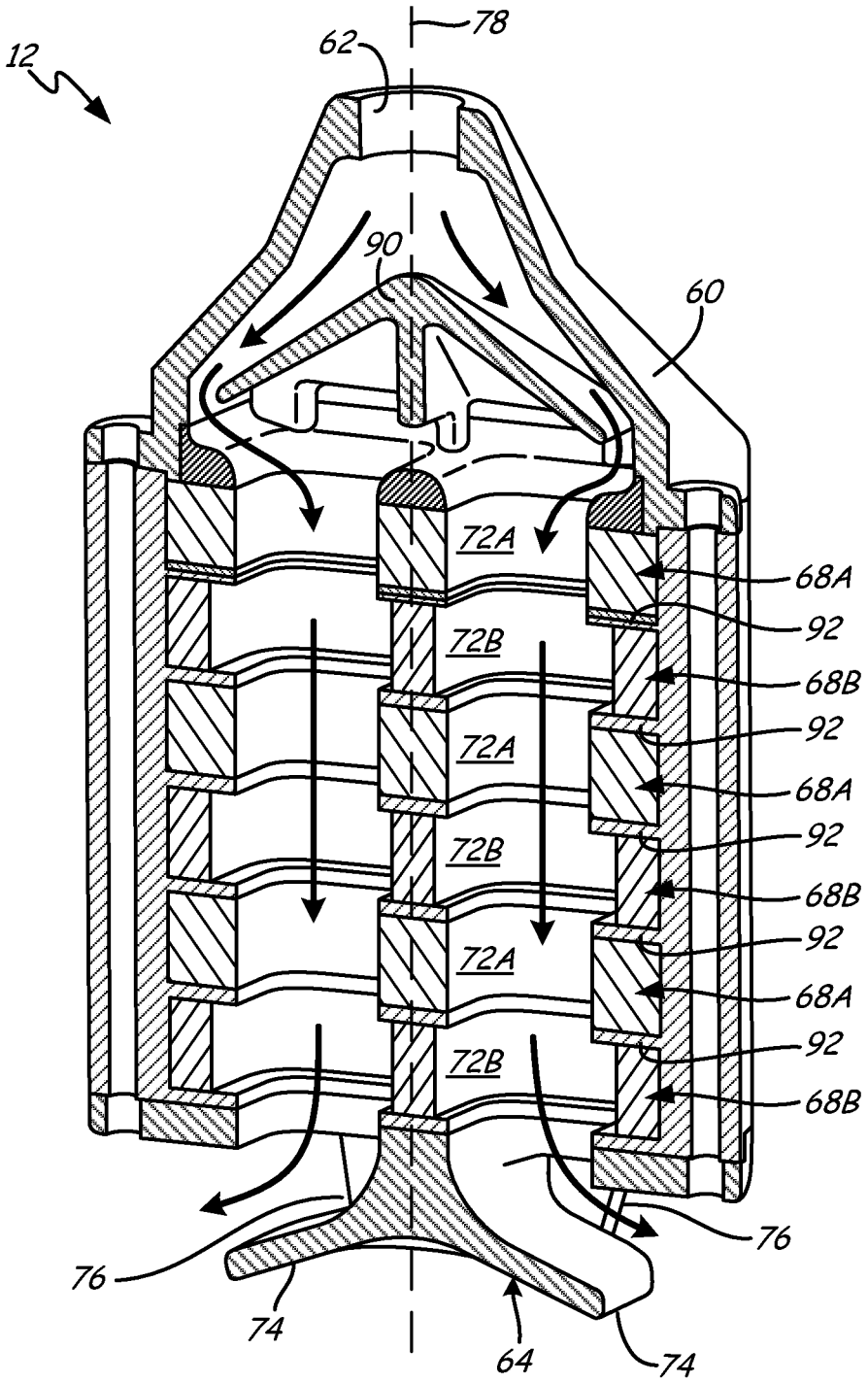
FIG. 4 is a front cross-section view of an alternate embodiment muffler showing a deflection cone, sound absorbing material, and support plates.

In FIG. 4, a front cross-section view of an alternate embodiment muffler 12 is shown, including deflection cone 90, sound absorbing material 68, and support plates 92. Shown in FIG. 4 are muffler 12, muffler case 60, muffler inlet 62, pathway 66, sound absorbing material 68A-68B, ducts 72A-72B, muffler axis 78, deflection cone 90, and support plates 92.

In the illustrated alternate embodiment muffler 12, muffler inlet 62 is parallel to muffler axis 78. In order to create a non-line-of-sight flow path for the gas, deflection cone 90 is positioned in pathway 66 between muffler inlet 62 and ducts 72.

Also included in the alternate embodiment muffler 12 are sections of sound absorbing material 68A-68B having differently sized ducts 72A-72B. More specifically, sound absorbing material 68A has duct 72A with less cross-sectional area than duct 72B of sound absorbing material 68B. This arrangement increases the surface area of sound absorbing material 68A-68B exposed to the exiting gas and can cause sound reflections that can lead to destructive interference.

In addition, support plates 92 are attached to the inside of muffler case 60 and are axially positioned between sections of sound absorbing material 68A-68B. Support plates 92 can be comprised of a rigid material, such as aluminum, or of a flexible material, such as rubber. In the illustrated embodiment, support plates 92 include the same hole pattern as ducts 72A to allow for gas flow through support plates 92.

The components and configuration of alternate embodiment muffler 12 as shown in FIG. 4 allow for an inline connection to muffler 12 without adding a line-of-sight flow path for exhausting gas. Additionally, support plates 92 structurally support sound absorbing material 68 and can assist with decreasing the noise level of muffler 12 by noise reflection.

Figure 5:
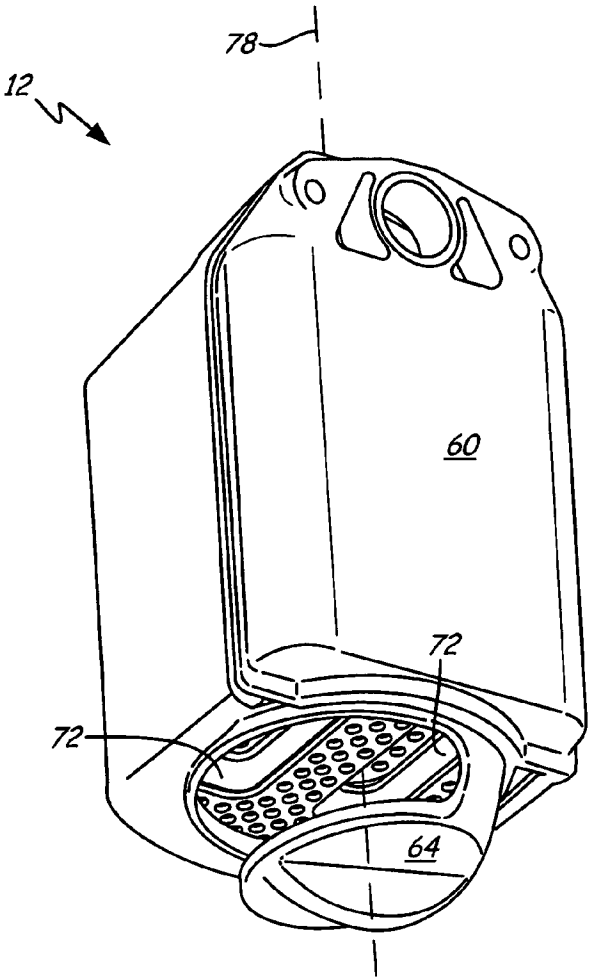
FIG. 5 is a perspective view of an alternate embodiment muffler showing an alternate embodiment diffuser.

In FIG. 5, a perspective view of an alternate embodiment muffler 12 is shown, including an alternate embodiment diffuser 64. Shown in FIG. 5 are muffler 12, muffler case 60, diffuser 64, and muffler axis 78.

In the illustrated alternate embodiment muffler 12, diffuser 64 is scoop-shaped and is rotatably attached to muffler case 60. More specifically, diffuser 64 includes a groove around the circular ring at top of diffuser 64. Diffuser 64 is captured when the two halves of muffler case 60 are joined, with the bottom of muffler case 60 fitting in the groove. Diffuser 64 has an L-shaped extension below the circular ring made up of a support or strut that extends from the ring and a generally circular deflection plate or ramp spaced from and aligned with the opening defined by the circular ring.

In such an embodiment, the gas flow from both ducts 72 is directed in the same general direction through an opening in diffuser 64. More specifically, gas flow is prohibited by the support or strut portion diffuser 64 through a substantial angle. The orientation of diffuser 64 (and therefore, the direction of exhaust flow) is selectable by the operator by rotating diffuser 64 about muffler axis 78. A detent (not shown) allows for positioning of diffuser 64 every forty-five degrees.

The components and configuration of alternate embodiment muffler 12 as shown in FIG. 5 allow the operator of motor 10 (shown in FIG. 1) to orient the exhaust gas flow, preventing it from flowing in a disadvantageous direction (for example, toward the operator). This orientation occurs without resulting in the formation of an exhaust gas jet.

Depicted in FIG. 5 is one embodiment of the present invention, to which there are alternative embodiments. For example muffler 12 can have a detent that allows for positioning in even increments other than forty-five degrees (such as every thirty degrees). Alternatively, muffler 12 can use friction in the joint between muffler case 60 and diffuser 64 in order to hold diffuser 64 in a particular orientation.

Figure 6:
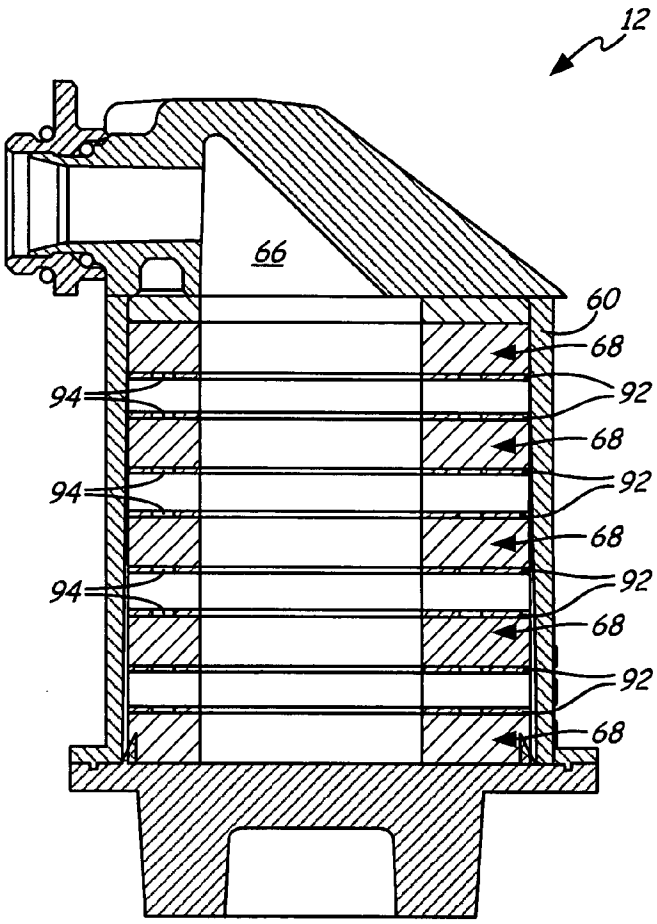
FIG. 6 is a side cross-section view of an alternate embodiment muffler showing sound absorbing material and support plates.

In FIG. 6, a side cross-section view of an alternate embodiment muffler 12 is shown, including sound absorbing material 68 and support plates 92. Shown in FIG. 6 are muffler 12, muffler case 60, pathway 66, sound absorbing material 68, and support plates 92.

In the illustrated alternate embodiment of muffler 12, support plates 92 have axial holes 94 that are covered on one side by sound absorbing material 68. This is because sound absorbing material is positioned alternately between support plates 92. This leaves open spaces in pathway 66 where there is no sound absorbing material between pathway 66 and muffler case 60. The components and configuration of alternate embodiment muffler 12 as shown in FIG. 6 can allow for better noise reduction capability, depending on the operational parameters. This can occur due to support plates 92 causing noise reflection and destructive interference. In addition, during long periods of operation, frost accumulation is less in the open spaces between support plates 92 than it is in ducts 72. Because of axial holes 94, the gas can still reach sound absorbing material 68 through support plates 92.

It should be recognized that the present invention provides numerous benefits and advantages. For example, the noise level of gas being exhausted from motor 10 is reduced to an acceptable level. For another example, ice that is formed by motor 10 can exit motor 10 without undue restriction from muffler 12. For a further example, motor 10 can be more compact because muffler 12 is alongside motor body 30.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An exhaust muffler for a positive displacement pneumatic motor, the muffler extending along an axis and having a first end and a second end, the muffler comprising:

a case;

an inlet attached to the case at the first end of the muffler;

a diffuser directly attached to the case and extending from an exterior of the case at the second end of the muffler;

a pathway extending between the inlet and the diffuser; and a sound absorbing material positioned in the pathway, the sound absorbing material including a first duct and a second duct through which gas passes, the first and second ducts extending parallel to the axis;

wherein the diffuser comprises:

a first ramp that directs gas from the first duct in a first direction away from the axis; and a second ramp positioned opposite of the first ramp that directs gas from the second duct in a second direction away from the axis;

wherein the first direction and the second direction are different;

wherein the first duct and the second duct are fluidly connected to the inlet and are fluidly separate from one another through the diffuser such that a first flow through the first duct exits the muffler along the first ramp and a second flow through the second duct exits the muffler along the second ramp; and wherein the inlet, diffuser, pathway, and sound absorbing material are configured to provide an unobstructed route for ice to pass through the muffler.

2. The muffler of claim 1, wherein the inlet is oriented substantially orthogonally to the first and second ducts.

3. The muffler of claim 2, wherein the inlet further comprises:

a ridge positioned to split gas flow between the first duct and the second duct.

4. The muffler of claim 1, wherein the sound absorbing material is comprised of a plurality of layers of sound absorbing material that are stacked axially in the case.

5. The muffler of claim 4, wherein the layers of sound absorbing materials have a plurality of cross-sectional areas.

6. The muffler of claim 4, wherein there is a gap between layers of sound absorbing material.

7. The muffler of claim 4, wherein the layers of sound absorbing material are axially bounded by plates comprised of support material.

8. The muffler of claim 7, wherein one of the plates has an axial hole in addition to a plurality of holes for the first and second ducts.

9. The muffler of claim 1, wherein the first and second ducts separated by a septum composed of sound absorbing material.

10. The muffler of claim 1, wherein the first direction and the second direction are oriented at the same angle with respect to the axis and on opposite sides of the axis.

11. The muffler of claim 1, wherein the first duct and the second duct are positioned closer to a first side of the sound absorbing material than to a second, opposite side of the sound absorbing material.

12. The muffler of claim 1, wherein the first duct and the second duct separated by a septum comprised of sound absorbing material, and wherein a first position of the first duct and a second position of the second duct in the sound absorbing material are offset from the case towards the septum.

13. A positive displacement pneumatic motor comprising:

a motor body;

a fluid inlet attached to the motor body for supplying fluid to the motor;

a pneumatic inlet attached to the motor body for supplying compressed gas to the motor;

a piston positioned in the motor body, the piston being movable due to force from the compressed air, and the piston exerting force on the fluid when the piston moves;

a pneumatic outlet attached to the motor body for expelling compressed gas from the motor after exerting force on the piston; and a muffler attached to the pneumatic outlet for reducing the sound emanating from the pneumatic outlet and extending along an axis and having a first end and a second end, the muffler comprising:

a case;

an inlet attached to the case at the first end of the muffler;

a diffuser directly attached to the case and extending from an exterior of the case at the second end of the muffler;

a pathway extending between the inlet and the diffuser; and a sound absorbing material positioned in the pathway, the sound absorbing material including a first duct and a second duct that extend through and are surrounded by the sound absorbing material, respectively, through which the gas passes, wherein the first and second ducts extend parallel to the axis;

wherein the diffuser comprises:

a first ramp that directs gas from the first duct in a first direction away from the axis of the duct; and a second ramp that directs gas from the second duct in a second direction away from the axis of the duct;

wherein the first direction and the second direction are different;

wherein the first duct and the second duct are fluidly connected to the inlet and are fluidly separate from one another through the diffuser such that a first flow through the first duct exits the muffler along the first ramp and a second flow through the second duct exits the muffler along the second ramp; and wherein the inlet, diffuser, pathway, and sound absorbing material are configured to provide an unobstructed route for ice to pass through the muffler.

14. The motor of claim 13, wherein the positive displacement pneumatic motor is a double diaphragm pump.

15. The motor of claim 13, wherein the sound absorbing material is comprised of a plurality of layers of sound absorbing material that are stacked axially in the case.

16. The motor of claim 13, wherein the first direction and the second direction are oriented at the same angle with respect to the axis and on opposite sides of the axis.

17. The motor of claim 13, wherein the first duct and the second duct are positioned in the sound absorbing material closer to a first side proximate the pneumatic outlet than to a second, opposite side.

18. The motor of claim 13, wherein the inlet is oriented substantially orthogonally to the first duct and the second duct.

19. The motor of claim 18, wherein the inlet further comprises:

a ridge positioned to split gas flow between the first duct and the second duct.

20. The motor of claim 13, wherein the first duct and the second duct separated by a septum comprised of sound absorbing material, and wherein a first position of the first duct and a second position of the second duct in the sound absorbing material are offset from the case towards the septum.

* * * * *